United States Patent [19]

Rittich et al.

[11] Patent Number: 4,580,587

[45] Date of Patent: Apr. 8, 1986

[54] FILLED BRUSHING DEVICE

[76] Inventors: Boje Rittich, Harvestehuder Weg 104, 2000 Hamburg 13; Marco Tomenzoli, Heilwigstrasse 67, D-2000 Hamburg 20, both of Fed. Rep. of Germany

[21] Appl. No.: 666,293

[22] Filed: Oct. 30, 1984

[30] Foreign Application Priority Data

Nov. 22, 1983 [DE] Fed. Rep. of Germany ... 8333430[U]
Sep. 7, 1984 [EP] European Pat. Off. ..... 84110688.3

[51] Int. Cl.[4] ..... A45D 44/18

[52] U.S. Cl. ..... 132/84 R; 401/173; 132/84 B

[58] Field of Search ..... 401/171, 172, 173, 268, 401/275, 277, 286, 289; 132/84 R, 84 B, 84 D, 85; 15/167 R, 167 A

[56] References Cited

U.S. PATENT DOCUMENTS

| | | | |
|---|---|---|---|
| 1,968,686 | 7/1934 | Janer | 401/173 |
| 1,973,158 | 9/1934 | Small et al. | 401/173 |
| 3,995,648 | 12/1976 | Kuryla | 401/173 |
| 4,277,194 | 7/1981 | Smith | 401/173 |

*Primary Examiner*—Gene Mancene
*Assistant Examiner*—Carolyn A. Harrison
*Attorney, Agent, or Firm*—Staas & Halsey

[57] ABSTRACT

A filled toothbrush or filled shaving brush which includes a tubular handle 4, in the hollow of which toothpaste or shaving snap is placed. At one end of the handle is a removable bristle holder, supplied with bristles, snap mounted so that it can be turned relative to the handle. The bristle holder has a connecting channel which leads from the bristles into the hollow of the handle and up to its end. A metering piston is mounted on the connecting channel and can be moved axially by rotating the handle relative to the bristle holder, and is at the same time prevented from rotating, relative to the connecting channel. Both the outer circumference of the piston and the inner surface of the handle are threaded to effect axial movement of the piston. The axis of bristle holder 1 may be offset from the rotational axis of handle 4 so that unintentional turning of the bristle holder relative to the handle, when in use, is prevented.

11 Claims, 15 Drawing Figures

(E-E)

(A-A)

(B-B)

(C-C)

(D-D)

FILLED BRUSHING DEVICE

BACKGROUND OF THE INVENTION

The present invention relates to a filled toothbrush and a filled shaving brush containing a removable handle with a supply of brushing material which is automatically supplied to the brush bristles upon rotation of the handle relative to the bristles.

One type of filled toothbrush known in the art is shown in German Gebrauchsmuster 79 04 943. In the design of this known filled toothbrush, a metering piston is joined to a connecting channel or pipe by a threaded connection and can be turned together with the handle by friction, i.e. actuated by adherence, and moved axially along the handle owing to the threaded connection. In the case of such a filled toothbrush, when the bristle holder is connected to the handle for first use, the metering piston is located at that end of the handle which is to be connected to the bristle holder. The connecting channel therefore has to be screwed with its thread through the metering piston along the entire length in order to reach the operating position. This is laborious and in practice often leads to misoperation.

SUMMARY OF THE INVENTION

It is an object of the present invention to provide a filled toothbrush or shaving brush having a removable handle portion filled with brushing material which is easy to operate, and in particular can be made operable quickly and where misoperation is avoided.

According to the invention, a filled brushing device is provided comprising a bristle holder and a removable, tubular handle provided with a supply of brushing material. The bristle holder includes a connecting channel or pipe member for insertion through a metering piston into the tubular handle. An interlocking connection is provided between the connecting channel and the metering piston, which permits axial movement of the metering piston relative to the connecting channel but prevents rotation between the two parts. A threaded connection is located between the interior surface of the handle, which serves as a storage compartment, and the exterior surface area of the metering piston. In use, the metering piston initially is located at that end of the handle which is to be connected to the bristle holder. The connecting channel or pipe forming part of the bristle holder is inserted into an appropriate aperture of the metering piston and pushed through the piston to its end position. If desired, the aperture may be sealed with a destructible foil. The bristle holder and handle are firmly joined together via an appropriate snap connection which permits relative rotational movement between the bristle holder and the handle. When the handle is turned, the metering piston is moved towards the other end of the holder, and presses the brush material such as toothpaste or shaving soap into the bristle area.

The threaded portion on the interior surface of the handle can either be preformed, e.g. by injection moulding when made of plastic, or it can be a self-tapping thread which is formed by the piston thread when the piston is first rotated. In this case suitable non-rigid plastic must be present in sections or longitudinal strips on the interior surface of the handle to enable the thread to be properly formed without splintering the plastic. If the thread design is only formed at certain sections running longitudinally of the handle, then it can be preformed by injection moulding during manufacture. The tool used can be formed so that it can be moved out of the area with the threaded sections and then pulled out of the hollow space inside the handle.

The handle may be formed with a removable threaded cap on each end so that recharging of the brushing material is possible. In that case, the handle is simply turned round when empty, i.e. when the metering piston has reached the other end position. The metering piston is then again located at the end which is to be connected to the bristle holder. The other end is open and can be used for recharging. After recharging has taken place the cap is replaced. Also in this case the connecting channel need not be screwed through the metering piston since the axial movement can be carried out freely.

The brush also may be formed with the axis of the bristle holder portion out of line or offset from the axis of the handle portion so that the moment arising from the force working on the bristles when in use is counteracted by a moment of torsion caused by the nonalignment of the axes, thus preventing the brush or bristle holder from rotating around the axis of the handle.

The design of the filled shaving brush may include a sealing cover or nozzle having an opening therein mounted at the bristle end of the connecting channel so that good distribution is ensured in the sense of enlarging the surface of the shaving soap, i.e. the shaving soap reaches the entire bristle area from the start where possible.

Hereafter the invention is described in detail with reference to the diagrams accompanying drawings.

DESCRIPTION OF THE PREFERRED EMBODIMENTS

Figure 1:
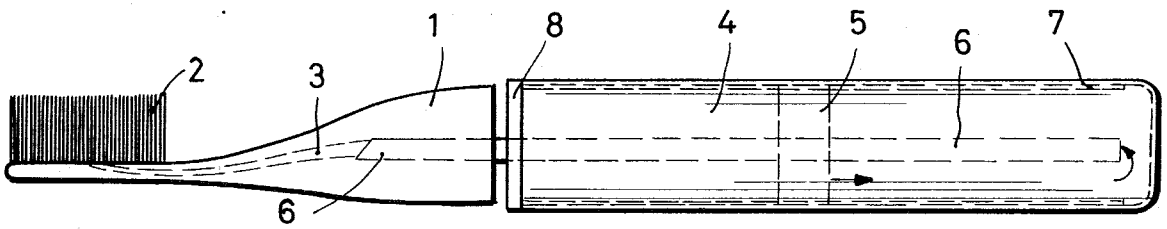
FIG. 1 is a side view of a type of filled toothbrush according to the invention showing the handle with a closed end and partially disconnected from the bristle holder portion.
Figure 2:
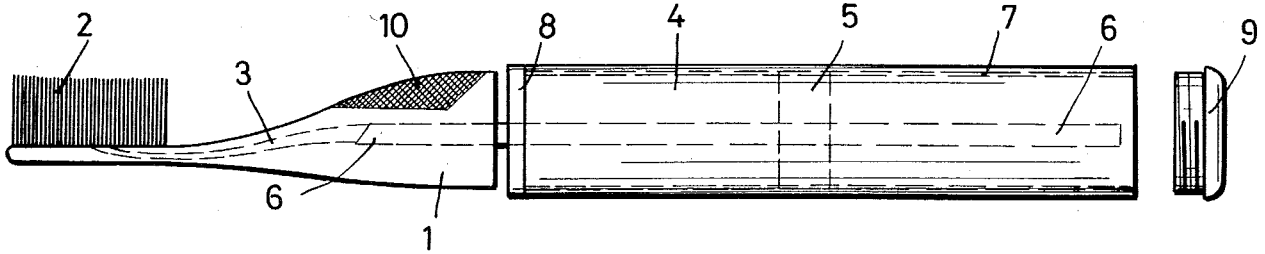
FIG. 2 is a side view of an altered form of the device of FIG. 1 showing a removable cap at one end of the handle and the handle partially disconnected from the bristle holder portion.

Both designs of the filled toothbrush shown in FIGS. 1 and 2 of the drawings are composed of a bristle holder 1 with bristles 2 at the front end thereof to which the toothpaste is transported by a tube 3. Tube 3 leads into a rigid connecting channel 6 at the back end of the bristle holder which has a non-round cross-section.

Handle 4, which serves as a storage compartment for the toothbrush, is attached at its front end to bristle holder 1 and may be provided with a ribbed gripping surface 10. Handle 4 and bristle holder 1 are connected so that they can only be separated axially if an appropriate amount of strength is used. The handle can however easily be turned relatively to the bristle holder. Inside the handle is a metering piston 5 with an external thread which engages with an internal thread 7 on the inside surface of the handle. An aperture in the centre of metering piston 5 has a cross-section corresponding to the cross-section of connecting channel 6, so that metering piston 5 may be moved axially along connecting channel 6 but cannot be turned relatively to this component. There is an interlocking connection between metering piston 5 and connecting channel 6.

Figure 3:
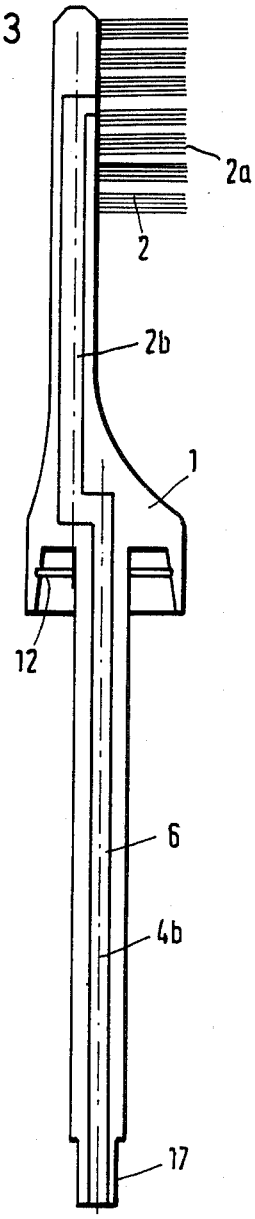
FIG. 3 is a sectional view of one type of a bristle holder having a connecting channel with an axis offset from the axis of the bristle holder portion.
Figure 6:
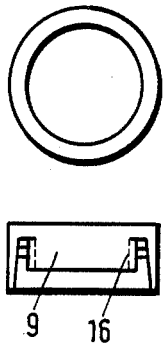
FIG. 6 is a top view and a sectional view of a cap, for use with the handle shown in FIG. 5.
Figure 5:
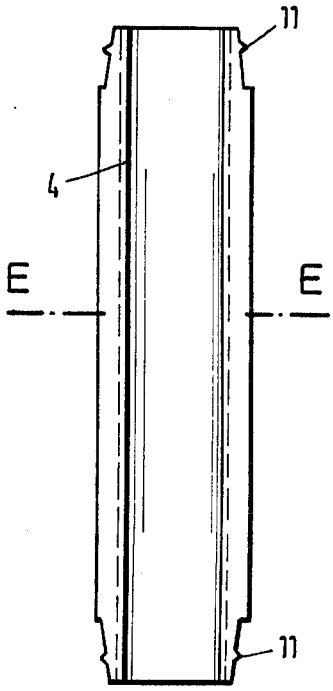
FIG. 5 is a sectional view of a handle open at both ends, to be used in connection with the devices shown in FIGS. 3 and 4.

In FIGS. 1 and 2, the handle 4 and the bristle holder 1 are shown in partially assembled relationship. The connecting channel 6 is not completely inserted into handle 4. When the connecting channel is fully inserted into the handle, a snap connection 8 is formed which locks the handle to the bristle holder while still permitting relative rotation therebetween. A suitable snap connection is shown in FIGS. 3 and 5 as comprising a ring projection 11 adjacent one end of the handle 4 shown in FIG. 5 which snaps into ring-shaped groove 12 in bristle holder 1 shown in FIG. 3 to form a snap connection when the handle and bristle holder are in a fully assembled position.

When the filled toothbrush is to be put into use and the handle has been filled with toothpaste, piston 5 is positioned at one end (on the left in FIG. 1). The hole, which has a cross-section corresponding to the cross-section of connecting channel 6 is closed with a destructible foil. The connecting channel is inserted into the hole thus rupturing the foil when snap connection is established. The back open end of the connecting channel is now near the back end of handle 4. When handle 4 is then turned relatively to bristle holder 1, metering piston 5 presses toothbrush into and through the connecting channel up to the area of the bristles 2.

The design as shown in FIG. 2 differs in that internal thread 7 continues through both ends of the handle. Both ends are formed practically identically. In the case of the design shown in FIG. 2, when the handle is completely empty, cap 9 can be unscrewed. The handle can then be turned through 180° and reattached to bristle holder 1 or to a new bristle holder. Metering piston 5 is again located at the end connected to bristle holder 1. The other end is open and can be recharged. After recharging, this end is closed by screwing on cap 9.

The filled toothbrush according to the invention allows the bristles to be automatically supplied with toothpaste as long as there is toothpaste in the handle. The handle, which constitutes a cartridge, may be a disposable component or a rechargeable component. The connection and design of the metering piston in relation to the connecting channel are selected so that simple preparation for first use and simple operation of the toothbrush are possible.

Figure 4:
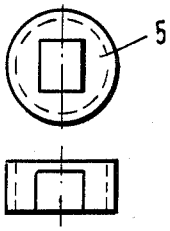
FIG. 4 is a top view and a sectional view of a metering piston, to be used in connection with the bristle holder shown in FIG. 3.
Figure 7:
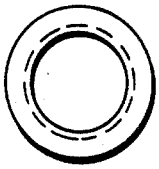
FIG. 7 is a sectional view of lines E—E in FIG. 5.
Figure 12:
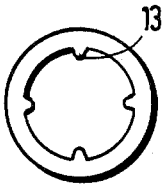
FIG. 12 is a sectional view taken along lines A—A in FIG. 8.

The designs shown in FIGS. 3 to 7 differ only slightly from the design in FIG. 2. In the design of FIG. 4, both ends of handle 4 have ring-shaped projections 11 which are for the snap connection with ring-shaped grooves 12 in bristle holder 1. A cap 9 (FIG. 6) is provided with a thread 6 so that it can be screwed into the handle, i.e. at the end at which the bristle holder is not located.

Referring to the design of FIG. 3, axis 2*b*, around which the applied force acting on surface 2*a* generates a moment of torsion, is out-of-line with axis 4*b* of handle 4. This prevents bristle holder 1 from rotating around axis 4*b* while the toothbrush is in use. Such a rotation would not only impair the use of the toothbrush when brushing or even render use impossible but would also give rise to unintentional displacement of metering poston 5.

Figure 9:
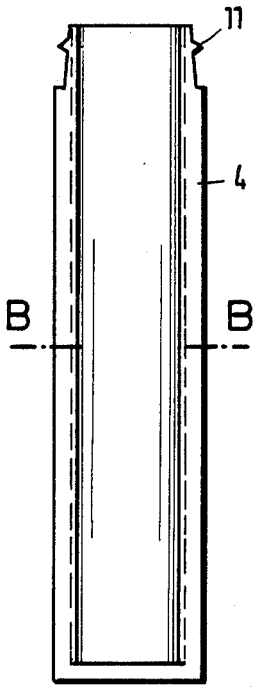
FIG. 9 is a sectional view as in FIG. 8 but with a continuous preformed thread.
Figure 10:
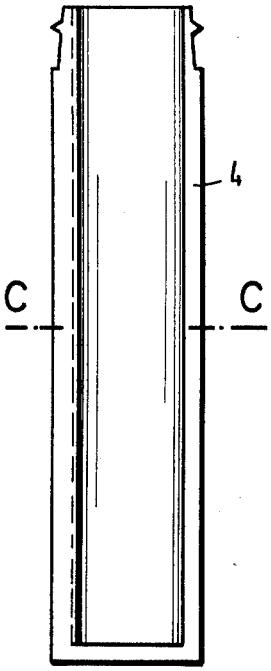
FIG. 10 is a sectional view as in FIGS. 8 and 9 but with a thread present only on some longitudinal sections.
Figure 11:
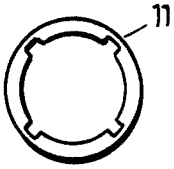
FIG. 11 is a sectional view taken along lines D—D in FIG. 8.

The designs shown in FIGS. 8 to 14 refer to different thread forms. In the case of the designs shown in FIGS. 8 and 12, projections 13 of non-rigid plastic are provided only at several points running longitudinally of handle 4, into which the thread is tapped by metering piston 5 during first use. This must take place without splintering. If such a self-tapping thread is desired then other designs are conceivable, as long as it is ensured that no splinters arise which could then penetrate into the toothpaste or shaving soap, and as long as the thread is guaranteed to be tapped. As can be seen in FIG. 11, there is no continuous ring-shaped projection 11 at the upper end of handle 4, but ring-shaped projection 11 is at several points divided to ensure that air can escape from this part when the handle is being recharged.

Figure 13:
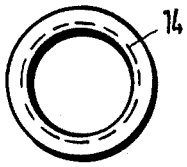
FIG. 13 is a sectional view taken along lines B—B in FIG. 9.

The design of FIGS. 9 and 13 corresponds to that of FIG. 1. The internal thread marked 14 which lies on the interior surface is continuous and is preformed by injection moulding during manufacture of handle 4.

Figure 14:
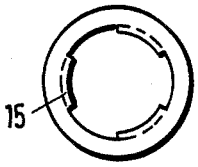
FIG. 14 is a sectional view taken along lines C—C in FIG. 10.
Figure 8:
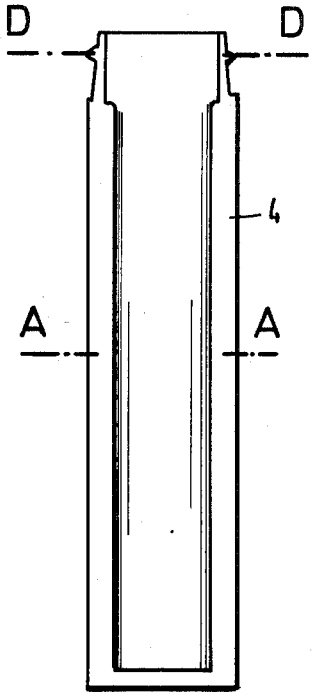
FIG. 8 is a sectional view of a handle with a self-tapping thread.

Since manufacture of the thread by injection moulding can be difficult, another possibility has been selected for designs as shown in FIGS. 10 and 14. Here internal thread 15 is only provided at a few points which run longitudinally so that after handle 4 has been manufactured in a suitable form, the core used in the manufacture can be turned and pulled out of the form.

Figure 15:
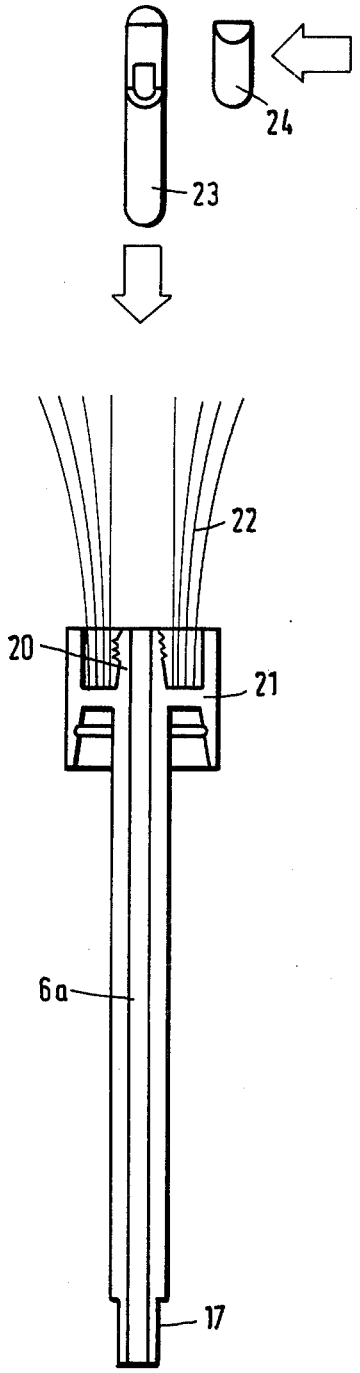
FIG. 15 is a sectional view of a bristle holder with a connecting channel and a nozzle for distribution of the shaving soap for a shaving brush according to the invention.

FIG. 15 shows a bristle holder with connecting channel 6*a* for a filled shaving brush. Here the outlet aperture for the shaving soap is located in the rotational axis as there is no reason to expect a relative rotation between bristle holder 1 and the handle. A sealing cover or nozzle 23, 24 can be placed on projection 20. This cover has a slit aperture which enables distribution of the shaving soap (surface enlargement) so that, as far as possible, this reaches all the bristles 22. The diagram shows the parts separately. In reality, component 24 is formed together with component 23 as one part, and this nozzle 23 sits on projection 20. This nozzle formed of parts 23 and 24 can also be called a "flute seal" as the tube for the shaving soap ends in a slit or opening provided between parts 23 and 24 and the upper end is cut off obliquely, as it is in the case of a flute.

The end of the filled channel 6, designated as 17 in FIGS. 3 and 15, has a smaller diameter or reduced cross-sectional area so that metering piston 5 is no longer prevented from rotating but rather may rotate realtive to the connecting channel when it has reached its end position. This prevents destruction.

Numerous alterations and modifications of the structure herein disclosed will suggest themselves to those skilled in the art. It is to be understood, however, that the present disclosure relates to the preferred embodiments of the invention which is for purposes of illustration only and is not to be construed as a limitation of the invention. All such modifications which do not depart from the spirit of the invention are intended to be included within the scope of the appended claims.

What I claim is:

1. A brushing device filled with brushing material comprising:

a bristle holder having a front end with bristles and a back end;

a removable, tubular handle having a front end connected to said back end of said holder and a back, closed end, said handle having a hollow threaded interior adapted to contain a supply of brushing material;

an exteriorally threaded piston for engagement with said threaded, interior of said handle and axially movable within said handle, said piston normally being positioned adjacent said front end of said handle when said handle is filled with said brushing material;

a connecting channel having a front end extending through said connecting end of said bristle holder to said bristles and a back, open end and extending through said piston and said handle whereby said back, open end is adjacent said closed end of said handle, said connecting channel and said piston having an interlocking connection therebetween whereby said piston is prevented from rotating relative to said connecting channel; and wherein said handle is rotatable relative to said holder and said connecting channel to cause said piston to move axially along said connecting channel toward the closed end of said handle to force said brushing material into said open end of and through said connecting channel to said bristles.

2. A brushing device as recited in claim 1, wherein said closed end of said handle is closed with a removable cap.

3. A brushing device as recited in claim 2, wherein said handle is formed symmetrically at each end so that said cap can be attached at either end.

4. A brushing device as recited in claim 1, wherein said interior of said handle is threaded only at spaced longitudinal sections.

5. A brushing device as recited in claim 1, wherein said threaded interior of said handle is formed without splintering by the threads of said piston when said piston is first rotated in said handle.

6. A brushing device as recited in claim 1, wherein both said bristle holder and said handle have a longitudnal axis, said axis of said bristle holder being offset from said axis of said handle.

7. A brushing device as recited in claim 1 wherein said handle has a projection adjacent its front end and said bristle holder has a groove adjacent its back end, said projection and said groove forming a snap connection when said handle is connected to said bristle holder whereby said handle may rotate relative to said bristle holder while connected thereto.

8. A brushing device as defined in claim 7, wherein said projection comprises a continuous ring.

9. A brushing device as defined in claim 7, wherein said projection comprises a plurality of projections at spaced intervals around said handle.

10. A brushing device as defined in claim 1, wherein said connecting channel has a smaller diameter adjacent its back, open end whereby said piston is free to rotate relative to said connecting channel where said piston is in a position adjacent the back, closed end of said handle.

11. A brushing device as defined in claim 1, which includes a nozzle having an opening therein mounted at said front end of said connecting channel to distribute said brushing material to said bristles.

* * * * *